US006503350B2

(12) United States Patent
Martin et al.

(10) Patent No.: US 6,503,350 B2
(45) **Date of Patent: *Jan. 7, 2003**

(54) VARIABLE BURN-RATE PROPELLANT

(75) Inventors: Joe A. Martin, Espanola, NM (US); Larry H. Welch, Newport Beach, CA (US)

(73) Assignee: Technanogy, LLC, Newport Beach, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/448,546

(22) Filed: Nov. 23, 1999

(65) Prior Publication Data

US 2002/0053377 A1 May 9, 2002

(51) Int. Cl.[7] ..... C06B 33/00; C06B 29/22; D03D 23/00

(52) U.S. Cl. ..... 149/37; 149/76; 149/109.6

(58) Field of Search ..... 149/37, 76, 109.6

(56) References Cited

U.S. PATENT DOCUMENTS

| | | | | |
|---|---|---|---|---|
| 3,370,537 A | | 2/1968 | Tepper | |
| 3,452,445 A | | 7/1969 | Higgins | 34/5 |
| 3,652,350 A | | 3/1972 | Timmermans | |
| 3,685,163 A | | 8/1972 | Olt | 34/5 |
| 3,706,608 A | | 12/1972 | Geisler | 149/6 |
| 3,744,427 A | | 7/1973 | Good | 102/100 |
| 3,745,077 A | | 7/1973 | Jones | |
| 3,761,330 A | * | 9/1973 | Lou et al. | 149/19.4 |
| 3,819,336 A | | 6/1974 | Rogers et al. | 23/302 |
| 3,830,673 A | | 8/1974 | Fletcher et al. | 149/17 |
| 3,888,017 A | | 6/1975 | McBride | 34/5 |
| 3,892,610 A | | 7/1975 | Huzinec | 149/76 |
| 3,954,526 A | | 5/1976 | Mangum et al. | 149/7 |
| 3,976,521 A | | 8/1976 | Boyd et al. | 149/5 |
| 4,092,189 A | | 5/1978 | Betts | |
| 4,177,227 A | | 12/1979 | Harvey et al. | 264/3 |
| 4,187,129 A | | 2/1980 | Bost et al. | 149/21 |
| 4,241,661 A | | 12/1980 | Elrick et al. | 102/103 |
| 4,764,319 A | * | 8/1988 | Hightower, Jr. et al. | 264/3.4 |
| 4,944,816 A | | 7/1990 | Sayles | 149/19.8 |
| 4,997,614 A | | 3/1991 | Kishi et al. | |
| 5,015,310 A | | 5/1991 | Sayles | |
| 5,034,070 A | | 7/1991 | Goetz et al. | |
| 5,049,212 A | * | 9/1991 | Colick | 149/3 |
| 5,273,785 A | * | 12/1993 | Sinclair et al. | 427/299 |
| 5,529,648 A | * | 6/1996 | Stickler | 149/19.1 |
| 5,579,634 A | | 12/1996 | Taylor | 60/219 |
| 5,597,947 A | | 1/1997 | Stephens | 44/268 |
| 5,714,711 A | | 2/1998 | Schumacher et al. | 102/291 |
| 5,717,159 A | | 2/1998 | Dixon et al. | 149/40 |
| 5,739,460 A | | 4/1998 | Knowlton et al. | |
| 5,771,679 A | | 6/1998 | Taylor, Jr. et al. | 60/219 |
| 5,798,480 A | | 8/1998 | Willer et al. | 149/19.4 |
| 5,889,161 A | | 3/1999 | Bottaro et al. | 534/551 |
| 5,912,069 A | * | 6/1999 | Yializis et al. | 428/213 |

FOREIGN PATENT DOCUMENTS

| | | |
|---|---|---|
| DE | 2 063 586 | 7/1971 |
| EP | 0 553 476 A1 | 8/1993 |
| EP | 0 699 645 A1 | 3/1996 |
| EP | 0 735 013 A1 | 10/1996 |
| EP | 0 767 155 A1 | 4/1997 |
| EP | 0 959 058 A1 | 11/1999 |
| GB | 930402 | 8/1959 |
| GB | 1 290 418 | 9/1972 |
| WO | WO 96/22954 | 8/1996 |

OTHER PUBLICATIONS

Chemical Abstracts: XP–000789753 / 6001 Chemical Abstracts: "Activated aluminum as a stored energy source for propellants"; dated Sep. 21, 1998.

Abstract: XO–000789724 / 6001 Chemical Abstracts; "Characterization of Electro–Exploded Aluminum"; dated Aug. 31, 1998.

"Solid Rockets": An Overview—Space; dated Jun. 2, 1997.

Propulsion Database Search Results; "Effects of Wires on Sollid Propellant Ballistics"; Sep. 1991.

Propulsion Database Search Results; "Burning Rate Enhancement Phenomena in End–Burning Solid Propellant Grains"; Jul. 1985.

Suryanarayan, Darbha; "Oxidation Kinetics of Aluminum Nitride"; Journal of American Ceramic Society; vol. 73, pp 1108–1110 (1990).

* cited by examiner

*Primary Examiner*—Michael J. Carone
*Assistant Examiner*—Aileen J. Baker
(74) *Attorney, Agent, or Firm*—Knobbe, Martens, Olson & Bear, LLP

(57) ABSTRACT

Disclosed are propellants such as may be used in solid rocket motors. In one preferred embodiment, the propellant comprises one high energy propellant composition comprising a homogeneous mixture of fuel and oxidizer having a predetermined fuel/oxidizer ratio, wherein individual fuel particles are generally uniformly distributed throughout a matrix of oxidizer, and a low energy propellant composition comprising a fuel and oxidizer. The amounts of the two propellants are present in amounts which achieve a preselected burn rate.

26 Claims, No Drawings

VARIABLE BURN-RATE PROPELLANT

FIELD OF THE INVENTION

This invention relates to propellants such as may be used in solid rocket motors. In preferred embodiments, the propellant comprises one high energy propellant composition comprising a homogeneous mixture of fuel and oxidizer present in a predetermined ratio, wherein individual fuel particles are generally uniformly distributed throughout a matrix of solid oxidizer, and a low energy propellant composition comprising a fuel and oxidizer. The amounts of the two propellants are present in amounts which achieve a preselected burn rate.

BACKGROUND OF THE INVENTION

Solid rocket motor propellants are widely used in a variety of aerospace applications, such as launch vehicles for satellites and spacecraft. Solid propellants have many advantages over liquid propellants for these applications because of their good performance characteristics, ease of formulation, ease and safety of use, and the simplicity of design of the solid fueled rocket motor when compared to the liquid fueled rocket motor.

The conventional solid propellant typically consists of an organic or inorganic solid oxidizing agent, a solid metallic fuel, a liquid polymeric binder, and a curing agent for the binder. Additional components for improving the properties of the propellant, i.e., processability, curability, mechanical strength, stability, and burning characteristics, may also be present. These additives may include bonding agents, plasticizers, cure catalysts, burn rate catalysts, and other similar materials. The solid propellant is typically prepared by mechanical mixing of the oxidizer and metallic fuel particles, followed by addition of the binder and curing agent with additional mixing. The resulting mixture is then poured or vacuum cast into the motor casing and cured to a solid mass.

The solid propellant formulations most widely used today in such applications as the Space Shuttle solid rocket booster and Delta rockets contain as key ingredients aluminum (Al) particles as the metal fuel and ammonium perchlorate (AP) particles as the oxidizer. The Al and AP particles are held together by a binder, which is also a fuel, albeit one of substantially less energetic content than the metal. The most commonly used binder comprises hydroxy-terminated polybutadiene (HTPB). This particular type of propellant formulation is favored for its ease of manufacture and handling, good performance characteristics, reliability and cost-effectiveness.

A typical Al+AP solid rocket propellant formulation consists of 68 wt. % AP (trimodal particle size distribution, i.e., 24 wt. % 200 $\mu$m, 17 wt. % 20 $\mu$m, 27 wt. % 3 $\mu$m), 19 wt. % Al (30 $\mu$m average particle diameter), 12 wt. % binder (HTPB) and isophorone diisocyanate (IPDI) curing agent), and 1 wt. % burn rate catalyst (e.g., Fe2O3 powder).

The relative amounts of the components in this formulation are chemically stoichiometric. In other words, there should be just enough oxidizer molecules present in the formulation to completely react with all the fuel molecules that are present, with no excess of either oxidizer or fuel. This formulation contains one oxidizer (AP) and two distinct fuels, i.e., Al and binder. The weight ratio of AP to Al for a stoichiometric mixture, i.e., no excess oxidizer or fuel, is 42:19. The weight ratio of ammonium perchlorate to binder for a stoichiometric mixture is 26:12. These ratios are the same regardless of any other components that may be present in the mixture.

Because of their burn characteristics, conventional Al/AP propellants are most suitable for use in conjunction with a particular motor design. This design is the hollow core or center perforated (CP) core motor design in which the propellant grain is formed with its outer surface bonded to the inside of the rocket motor's casing with a hollow core extending through most or all of the length of the grain. The burning front progresses radially outwardly from the core to the case. This motor design is by far the most common design for solid fuel motors. One example of a current application utilizing this design is the Space Shuttle, which uses solid motors which are 150 ft. long and 12 ft. in diameter with a 4 ft. hollow core.

The propellant grain in a CP design must have substantial structural integrity to keep the grain intact during operation. A binder is therefore used to "glue" the particulate components of the propellant together. During the initial mixing of the propellant, the percentage of the binder, initially in the form of a liquid resin, is high enough to maintain a relatively low viscosity, such that the propellant is in a slurry form, allowing the propellant mixture to be poured or injected into the motor casing. A mandrel is placed in the middle of the motor casing to create the hollow core (typically before the propellant is poured into the core) and is removed once the propellant has cured.

Propellants comprising a metal fuel in combination with a solid oxidizer may be used in other applications outside of aerospace, including gas generators. Solid propellants are also used in launch vehicles, e.g., NASA rockets, Space Shuttle, French Ariane rockets. Virtually all launch vehicles use a combination of liquid fuel motors with solid fuel boosters. Both the Delta III and the Space Shuttle are examples having combined liquid and solid motors. The Delta rocket has a main liquid motor with nine smaller strap-on solid boosters, while the shuttle has three onboard liquid motors with two strap-on solid boosters.

Although enormous innovations have occurred in guidance, electronics and virtually every part of spacecraft to date, the propulsion systems have remained essentially the same for decades. Boeing's Delta III, introduced in 1998, utilizes a liquid engine that was designed in the 1960's and is fueled by kerosene and oxidized by liquid oxygen. The solid boosters were designed in 1961 and are virtually unchanged since then, except for an epoxy motor casing. Additionally, over the past decade, almost every system on the Shuttle has been replaced or upgraded, except for its propellant. It is therefore desirable to provide a novel solid rocket propellant that affords superior performance to the conventional propellants in current use today.

SUMMARY OF THE INVENTION

A propellant is a composition of matter comprising at least one fuel and at least one oxidizer. The reduction/oxidation (redox) reaction between the fuel and oxidizer provides energy, frequently in the form of evolved gas, which is useful in providing an impulse to move a projectile such as a rocket or spacecraft. The present invention provides propellant compositions capable of achieving very high burn rates. The propellant compositions of the present invention may comprise a single fuel and oxidizer. In some embodiments, the propellants are mixed propellants. A mixed propellant is a mixture of at least two propellants. The two component propellants may have the same fuel and/or oxidizer, but there should be some difference, such as a different fuel particle size, additional or different catalyst, etc.

The present invention also provides methods of reducing the burn rates of the high burn rate propellants by varying their composition. Such methods include addition of lower burn rate materials and/or propellants, and altering the particle size of one or more components of a propellant as disclosed below. In preferred embodiments, the propellants disclosed are of the type which may be used in solid rocket motors such as are found in launch vehicles. Other embodiments may be used in other applications for propellants as may be known in the art.

In accordance with one aspect of the present invention there is provided a mixed solid propellant. The propellant comprises a first propellant composition comprising a substantially homogeneous mixture of fuel particles distributed throughout a matrix of a first oxidizer, and a second propellant composition comprising a fuel and a second oxidizer. In preferred embodiments, the second propellant is present in a quantity sufficient to modify the burn rate of the first propellant to achieve a preselected burn rate and/or the fuel particles and first oxidizer are present in stoichiometric quantities. The fuel particles are preferably micron or nanometer-scale particles, preferably metals. In especially preferred embodiments, the fuel particles are aluminum and the oxidizer is ammonium perchlorate.

In accordance with another aspect of the present invention, there is provided a method of preparing a mixed propellant having a preselected burn rate. Quantities of first and second propellant compositions are provided. The first propellant composition comprises a substantially homogeneous mixture of fuel particles generally uniformly distributed throughout a matrix of a first oxidizer. The second propellant composition comprises a fuel and an oxidizer. The first and second propellant compositions are mixed to form a generally uniform mixture wherein the quantity of the second propellant is sufficient to modify the burn rate of the first propellant to achieve the preselected burn rate.

In accordance with a further aspect of the present invention, there is provided a method of preparing a propellant having a preselected burn rate. Quantities of first and second propellant compositions are provided. The first propellant composition comprises a substantially homogeneous mixture of a first fuel and a first oxidizer. The components of the first propellant are present in a predetermined ratio, and the first fuel is generally uniformly distributed in the form of discrete particles throughout the first oxidizer. The second propellant composition comprises a second fuel and a second oxidizer. The first and second propellant compositions are mixed to form a generally uniform mixture, wherein the quantities of the first and second propellants are chosen to achieve the preselected burn rate according to the equation:

$$R = m_{total} / t = \frac{(m_f + m_s)}{m_f / R_f + m_s / R_s}$$

wherein $m_s$ is the mass of the slow burn rate component, $m_f$ is the mass of the fast burn rate component, $R_s$ is the burn rate of the slow burn rate component, and $R_f$ is the burn rate of the fast burn rate component.

In accordance with a further aspect of the present invention, there is provided a solid propellant comprising macroparticles of a composition comprising fuel particles distributed generally uniformly throughout a matrix of a first oxidizer, combined with a second fuel and a stoichiometric quantity of a second oxidizer.

In accordance with one preferred embodiment, there is provided a solid propellant comprising a first and a second propellant. The first propellant comprises an intimate, stoichiometric mixture of a first oxidizer and metallic fuel particles, and the second propellant comprises a fuel and a second oxidizer.

In accordance with one preferred embodiment, there is provided a solid propellant comprising a first and a second propellant. The first propellant comprises a mixture of a first oxidizer and metallic fuel particles wherein the average distance separating the metallic fuel particles is controlled. The second propellant comprises a fuel and a second oxidizer.

DETAILED DESCRIPTION OF THE PREFERRED EMBODIMENTS

Introduction

The following description and examples illustrate preferred embodiments of the present invention in detail. Those of skill in the art will recognize that there are numerous variations and modifications of this invention that are encompassed by its scope. Accordingly, the description of preferred embodiments should not be deemed to limit the scope of the present invention.

As used within this specification, the term "stoichiometric" refers to a mixture of chemical components having the exact proportions required for complete chemical combination or reaction. In terms of a rocket fuel composition, a stoichiometric mixture is one in which the components involved in the combustion process, including the metallic fuel and oxidizer, are present in exactly the quantities needed for reaction, without an excess of any component left over after the reaction.

The term "stoichiometry" refers to the ratio of oxidizer to fuel components in a mixture. The stoichiometry, or ratio, may be "stoichiometric", i.e., the oxidizer and fuel components are present in such amounts so that complete combustion occurs without any excess oxidizer or fuel. The stoichiometry may also be "non-stoichiometric", i.e., excess oxidizer or fuel is present in the mixture over that which is required for complete combustion of the mixture.

The term "homogeneous" refers to a mixture or blend of components that is generally uniform in structure and composition with little variability throughout the mixture. Different portions of a homogeneous mixture exhibit essentially the same physical and chemical properties at substantially every place throughout the mixture. The stoichiometry in a homogeneous mixture is also substantially constant throughout the mixture.

The term "metal" refers to alkali metals, alkaline earth metals, rare earth metals, transition metals, as well as to the metalloids or semimetals.

The term "metallic" refers to any substance incorporating a metal, including alloys, mixtures and compounds.

The term "oxidizer" refers to a substance that readily yields oxygen or other oxidizing substances to stimulate the combustion of a fuel, e.g., an oxidizable metal. Specifically, an oxidizer is a substance that supports the combustion of a fuel or propellant.

The term "fuel" refers to a substance capable of undergoing a oxidation reaction with an oxidizer. The term "propellant" refers to a composition comprising at least one fuel and at least one oxidizer. Other materials may be present, including additives and catalysts. The redox reaction between the fuel and oxidizer provides energy, frequently in the form of evolved gas, which is useful in providing an impulse to move a projectile such as a rocket or spacecraft.

The term "matrix" refers to the solid state of the oxidizer wherein one or more metallic fuel particles are substantially encapsulated or embedded within the solid structure, much like the holes in a piece of foam. The structure of the fuel/oxidizer matrix preferably simulates, maintains, or approximates the molecular order as is found in a solution of oxidizer and fuel particles, albeit with some or all of the solvent molecules removed. As such, in preferred embodiments, the metallic fuel particles are generally uniformly distributed throughout the matrix of solid oxidizer.

The phrase "intimate mixture," as it is used herein, means a mixture in which the components are present in a structure that is not composed of discrete, separate particles of the both materials, instead discrete particles of one component (the metallic fuel) is embedded within a network, crystal, semi-crystalline, amorphous or other solid structure of the other component (the oxidizer) such that the two components cannot be unmixed at the particle level by general physical methods, i.e. one would have to re-solvate or disperse the oxidizer in a solvent to unmix.

The term "Propulsion Potential" refers to the Isp (total impulse divided by the weight of propellant) as measured at low, near ambient pressures. This term is used to distinguish these low pressure tests and results from the industry standard measurement and reporting practices, which are generally conducted at very high (1000 psi) pressures.

The following section provides a detailed description of preferred embodiments of the invention. Preferred compositions in accordance with the present invention comprise a metallic fuel component and a solid oxidizer component. These components are combined to form a homogeneous mixture through the utilization of freeze drying and spray drying techniques. Such mixtures show superior burn rate characteristics when compared to prior art fuel-oxidizer mixtures.

The Metallic Fuel

The present invention utilizes a metallic particulate component as the fuel. This component can comprise metals such as aluminum, magnesium, zirconium, beryllium, boron and lithium. The metallic component can also comprise a metal hydride, e.g., aluminum hydride or beryllium hydride. Alternatively, mixtures of particles of different kinds of metals could be used. Other possibilities include alloys of two or more metals, or one or more metals in combination with one or more additional substances, e.g., other metal or nonmetal components, aluminum borohydride or lithium borohydride.

In accordance with the present invention, the most preferred metal fuel is aluminum. Aluminum is the most commonly used metal in solid rocket propellants, and is often selected because it is relatively inexpensive, non-toxic, has a high energy content, and exhibits good burning characteristics. Other preferred metal fuels include metals such as boron, beryllium, lithium, zirconium, sodium, potassium, magnesium, calcium, and bismuth. Mixtures and/or alloys comprising these materials are also contemplated for use in the present invention.

While there are many factors surrounding the use of a particular metal fuel, a primary factor is the ability to get the metal to rapidly chemically react, i.e., combust, and to sustain that chemical reaction. The method of one preferred embodiment enables the formation of an intimate, homogeneous mixture of fuel with oxidizer not possible in prior art methods. The nature of the mixture of oxidizer and fuel in this embodiment may also allow for compositions using fuels that are of lower atomic weight than aluminum to achieve a burn process and burn rate within a preferred range for propellants. Table 1 shows the atomic weights of various potential fuels.

TABLE 1

| Fuel | Atomic Weight (grams/mole) | Density | Melting Point (° F.) | Combustion Product | Heat of Combustion (BTU/lb) |
|---|---|---|---|---|---|
| Al | 27.0 | 168.5 | 1220 | $Al_2O_3$ | 13,400 |
| B | 10.8 | 145.5 | 4180 | $B_2O_3$ | 25,400 |
| Be | 9.0 | 113.6 | 2330 | BeO | 28,700 |
| Li | 7.0 | 32.8 | 354 | $Li_2O$ | 18,400 |

The lower atomic number fuels are desirable in that they have the potential to lower the weight of the motor relative to that for aluminum-based motors. One possible key to the success of such fuels is the existence of an appropriate passivation layer around the metallic particle. That passivation layer exists with aluminum in the form of $Al_2O_3$. The $Al_2O_3$ layer maintains the stability of the energetic aluminum particle while it is in intimate contact with the ammonium perchlorate oxidizer. If the reaction kinetics are too slow for these fuels when micron-sized particles are used, then nanometer-scale powders can be utilized.

The metallic particles of one preferred embodiment may be prepared by methods known in the art. Micron-sized metallic particles may be formed by methods involving mechanical comminution, e.g., milling, grinding, crushing. Such micron sized particles are commercially available from several sources, including Valimet of Stockton, Calif., and are relatively inexpensive.

Because the burn rate for a mixture of metallic fuel particles and oxidizer particles is dependent in part on average particle size, if a faster burn rate is desired, for some embodiments of the present invention it may be advantageous to use particles smaller than micron sized metallic particles produced by mechanical comminution. Nanometer-scale particles may be prepared by either the gas condensation method or the ALEX (exploded aluminum) method. In the gas condensation method, aluminum metal is heated to a vapor. The vapor then collects and condenses into particles. The particles thus produced are nominally spherical, approximately 40 nm in diameter and have a very tight size distribution (±5 nm to 10 nm). These particles are single crystals with negligible structural defect density and are surrounded by an aluminum oxide passivation layer approximately 2.5 nanometers in thickness.

In the ALEX method, a fine aluminum wire is placed in a low pressure inert gas and an electrical current is applied. The electrical discharge through the wire explodes it into aluminum vapor. The particles thus produced range in size from about 100 nm to 500 nm. Nanoaluminum made by the ALEX process is commercially available from several sources, including Argonide of Pittsburgh, Pa.

The rate of energy release for conventional metal fuels is relatively slow because of the relatively large (micron-sized)

particle sizes utilized. Nanometer-sized metal powders demonstrate superior performance in this regard by virtue of their very small particle size. Because of the particles' very small size, both the thermal capacity of each particle and the distance from the core of the particle to the outer surface area where chemical reactions can take place are greatly reduced. Preferably, the metal fuel particles used in preferred embodiments of compositions and propellants have a diameter of about 10 nanometers to about 40 micrometers, more preferably about 10 nanometers to about 10 microns. In one preferred embodiment, the fuel particles have a diameter of about 0.1 micrometer to 1 micrometer. In other preferred embodiments, the fuel particles have a diameter of about 20 nanometers to about 40 nanometers. Methods of preparing nanometal particles are known in the art (e.g. "Oxidation Behavior of Aluminum Nanoparticles", C. E. Aumann, G. L. Skofronick, and J. A. Martin, J. Vac. Sci. Technol. B 13(3), 1178, (1995); "Ultrafine Metal Particles", C. G. Granqvist and R. A. Buhrman, J. Appl. Phys., 47, 2200, (1976).).

The Solid Oxidizer Matrix

One preferred embodiment utilizes an oxidizer, preferably a solid, which is capable of being dissolved in a solvent. Alternatively, the oxidizer may be one which can be finely dispersed in a solvent or emulsified in a solvent or combination of solvents. One preferred solid oxidizer for use in conventional propellant formulations is ammonium perchlorate (AP). AP is a preferred oxidizer because of its ability to efficiently oxidize aluminum fuel to generate large quantities of gas at high temperature. Ammonium perchlorate is also highly soluble in water, dissolving to form an ionic liquid, making it particularly suitable for use in preferred embodiments.

There are several other preferred oxidizers for use in accordance with one preferred embodiment, including hydroxy ammonium perchlorate (HAP), ammonium nitrate (AN), cyclotetramethylene tetranitramine (HMX), cyclotrimethylene trinitramine (RDX), triaminoguanidine nitrate (TAGN), lithium perchlorate, sodium perchlorate, potassium perchlorate, lithium nitrate, sodium nitrate, and potassium nitrate. Any of these or other oxidizers, or mixtures thereof, may be used in preferred embodiments provided that they are capable of being dissolved, dispersed, suspended, emulsified or otherwise distributed into suitably small portions when placed in a solvent or solvent system such as a mixed solvent or emulsion, which may be polar, nonpolar, organic, aqueous, or some combination thereof. Preferred solvents or solvent systems are selected on the basis of their ability to dissolve, solvate, or disperse the oxidizer, while maintaining a minimum of reactivity towards the metallic fuel and oxidizer, at least for the time needed to complete the reaction. In accordance with a preferred embodiment, water is used as the solvent for AP.

The Metallic Fuel Particle —Solid Oxidizer Mixture

The reaction of AP (chemical formula $NH_4ClO_4$) with Al fuel is given by the chemical reaction:

$$2\ NH_4ClO_4+4\ Al \rightarrow 2\ Al_2O_3+2\ HCl+N_2+2\ H_2O+H_2\ \Delta H_{rxn}.2.5\ \text{kcal/g}$$

The weight ratio of AP to aluminum for a stoichiometric mixture, i.e., no excess oxidizer or fuel, is 42:19. AP will generally not react with aluminum oxide ($Al_2O_3$), favoring reaction with unoxidized aluminum metal, so the passivation layer forming the surface of the aluminum particle must be taken into consideration when calculating the proportions of AP to Al for a more precise stoichiometric mixture. When the aluminum is in the form of micron-sized particles, the $Al_2O_3$ passivation layer, which is approximately 2.5 nm thick, is practically negligible in weight compared to that of the unoxidized metallic aluminum within the particle. However, when the aluminum is in the form of nanometer-sized particles, the aluminum oxide passivation layer can comprise a substantial portion of the total weight of the particle, e.g., 30 to 40 wt. % or more. Therefore, when nanometer-sized particles are used, less oxidizer per unit weight aluminum fuel is needed for a stoichiometric mixture.

In order to maximize burn rate, or reaction velocity, it is important that the mixture of the metallic fuel and oxidizer be as homogeneous as possible. This is because the burn rate is determined by the reactant diffusion distance, or how far the reactants must travel in order to react with each other. The shorter the distance, the faster the two components can get together to react. In a well-mixed powder made up of metallic particles and oxidizer particles, the reactant diffusion distance corresponds to average particle size.

Minimizing the reactant diffusion distance using conventional methods of preparing propellants can be difficult. If the metallic fuel particles and oxidizer particles are mechanically mixed into a powder, then in order to minimize reactant diffusion distance, the metallic particles and oxidizer particles should both be as small as possible. Under the current state of the art, nanometer scale metal particles can be prepared. However, the smallest particle sizes that have commonly been achieved for ammonium perchlorate are on the order of a few microns in diameter. Therefore, if nanometer metal particles are used with micron-sized (e.g., 3 $\mu$m in diameter) oxidizer particles, reducing the particle size of the metal further will not have an appreciable effect on reactant diffusion distance since the oxidizer particle diameter dominates.

Another problem with achieving homogeneous mixtures via the conventional mechanical mixing techniques is that the metal particles or oxidizer particles can agglomerate, resulting in pockets of metal particles directly in contact with each other rather than the oxidizer, and vice versa. Such agglomeration will also increase the reactant diffusion distance, resulting in a slower burn rate.

A number of approaches for dealing with some of these concerns are disclosed in the prior art. One prior art approach to dealing with particle size utilizes a continuous process for preparing a solid propellant wherein an aqueous saturated solution of an oxidizer is added to an aqueous suspension of metal fuel particles. Particles of oxidizer containing occluded metal particles are then crystallized from solution. The metal particle-containing oxidizer particles are then recovered and the aqueous oxidizer solution is recycled. Another prior art method of tailoring solid rocket propellants involves addition of metal fuel particles to a saturated solution of oxidizer. The oxidizer then crystallizes out of solution, producing a precipitate consisting of metal particles coated with oxidizer. While both of these methods can produce a propellant wherein the metal particles coated with or encased within oxidizer, they have the disadvantage of not allowing the stoichiometry of metal to oxidizer to be accurately controlled.

Preparing the Mixture of Metallic Fuel Particles and Solid Oxidizer

In preferred embodiments, reactant diffusion distance is minimized by dispersing the metal fuel particles generally uniformly throughout a matrix of solid oxidizer. The techniques by which this is attained allow for the control of the average distance separating the components in the resulting composition. The means by which this dispersion of metal fuel particles in a solid oxidizer matrix is prepared in the method of one preferred embodiment involves preparing a solution of the oxidizer and adding the metal particles to the solution. The amount of metal particles relative to the amount of oxidizer in solution is preferably adjusted to provide a substantially stoichiometric mixture of fuel to oxidizer. Alternatively, a non-stoichiometric mixture of fuel to oxidizer may be prepared wherein the ratio of the two components is pre-selected. For solid rocket propellant applications, a substantially stoichiometric mixture is preferred. In the case of AP+Al mixtures, a stoichiometric mixture comprises approximately 31 wt. % Al (unoxidized metal) and 69 wt. % AP. Preferably the amount of aluminum in the unoxidized state varies no more than about 5%, more preferably 2% from the 31% by weight midpoint. In circumstances where a non-stoichiometric mixture is desired, the appropriate quantities of metal fuel component and oxidizer component can be selected to provide the desired ratio of fuel to oxidizer.

If desired, additional components may be added to the solution prior to the solvent removal step. These components may include soluble or insoluble solids, e.g., fuels, oxidizers, additives, emulsifiers, etc. Liquids that are miscible or immiscible in the solvent may also be added. Soluble or insoluble gases may also be introduced into the solution.

Generally the preparation of the compositions of a preferred embodiment proceeded as follows. An oxidizer, such as ammonium perchlorate (e.g., commercially available from Aldrich and Alfa) is dissolved with agitation in water to form a solution. The water used may include deionized water, distilled water, tap water or ultrapure water. The dissolution is preferably conducted at room temperature, although a suitable reduced or elevated temperature may be used. Preferably, approximately 20 parts by weight AP is used per 100 parts by weight water, although other suitable concentrations may be used. The concentration is preferably maintained sufficiently below the supersaturation level so that premature crystallization of the AP does not take place. Any suitable means of mixing the AP and water may be used, including agitation, or mechanical stirring. Metal fuel powder is added to the oxidizer solution thus produced. The quantities of oxidizer and metal fuel are selected so as to yield the desired stoichiometry between the components which is desired in the final composition. Other additional components may be added at any point in the process as desired.

After the metal particles and optional additional components are added to the solution, the insoluble components, including the metal fuel particles, must be generally uniformly distributed throughout the solution. One way in which a generally uniform distribution may be obtained is by agitating the solution, but any other suitable method for obtaining a generally uniform distribution may be utilized. Care must be taken to make sure that the solid particles are not allowed to settle out of solution. Smaller particles will take longer to settle out of solution than larger particles.

Once a generally uniform dispersion of particles throughout the solution is achieved, the next step involves removing the solvent from the mixture while preserving the homogeneous, intimate mix. Any suitable method for removing the solvent may be used. Suitable methods include spray drying and freeze drying.

Spray drying is widely used in industry as a method for the production of dry solids in either powder, granulate or agglomerate form from liquid feedstocks as solutions, emulsions and pumpable suspensions. The apparatus used for spray drying consists of a feed pump, rotary or nozzle atomizer, air heater, air disperser, drying chamber, and systems for exhaust air cleaning and powder recovery. In spray drying, a liquid feedstock is atomized into a spray of droplets and the droplets are contacted with hot air in a drying chamber. Evaporation of moisture from the droplets and formation of dry particles proceed under controlled temperature and airflow conditions. The powder, granulate or agglomerate formed is then discharged from the drying chamber. In some cases, it may be necessary to continue the stirring or agitation of the solution during the spray drying process so that the composition made at the end of the spraying procedure is still well mixed. By adjusting the operating conditions and dryer design, the characteristics of the spray dried product can be determined.

The spray drying method is especially preferred when the contact time between the metal particles and solvent need to be minimized. For example, when nanometer-sized aluminum particles are placed in room temperature water, they will completely react to form $Al_2O_3$ in less than 24 hours. Because of the small particle size, the reaction occurs very quickly once the passivation layer is penetrated. By using a spray drying technique, the time in which the aluminum particles are in contact with the water solvent can be minimized.

Another preferred method for removing the solvent is freeze drying. Freeze drying consists of three stages: pre-freezing, primary drying, and secondary drying. Before freeze drying may be initiated, the mixture to be freeze dried must be adequately pre-frozen, i.e., the material is completely frozen so that there are no pockets of unfrozen concentrated solute. In the case of aqueous mixtures of solutes that freeze at lower temperature than the surrounding water, the mixture must be frozen to the eutectic temperature. Once the mixture is adequately pre-frozen, then the solvent is removed from the frozen mixture via sublimation in the primary drying step. After the primary drying step is completed, solvent may still be present in the mixture in bound form. To remove this bound solvent, continued drying is necessary to desorb the solvent from the product.

In accordance with a preferred method of freeze drying used in making the compositions of the present invention, the freeze drying process is preferably initiated by pouring the mixture into a container immersed in a cryogen, such as liquid nitrogen or a dry ice/acetone bath. Similarly, the container in which the mixture was made may be immersed or otherwise exposed to a cryogenic liquid or placed in a freezer. In order to maintain the homogeneity of the mixture, it may be necessary to continue the stirring, agitation or other mixing means during the freezing process. Once the mixture has completely frozen the container of frozen mixture is then transferred to a vacuum container.

Preferred freeze drying apparatuses include standard high-vacuum chambers that are pumped by high-pumping-speed diffusion pumps. Such chambers are available commercially (e.g., the Varian VHS-6 cart-mounted pumping assembly #3307-L5045-303 with a 12"-diameter stainless steel bell jar assembly) and are in common use for vacuum deposition of metallic films and general purpose vacuum processing. An alternative, similar system can be assembled from off-the-shelf vacuum components available from a variety of suppliers. The specifics of the vacuum design are not critical, as long as the design incorporates high pumping speed (preferably 2000 liters/sec or better) and low ultimate pressure. Active pumping on the vacuum container is initiated as soon as practical after freezing the mixture. After a period of about 20 to 60 minutes, depending upon the specific pumping characteristics and volume of the vacuum chamber, the pressure in the system achieves a steady state near the equilibrium vapor pressure of the frozen solvent (in the $10^{-3}$ Torr range for water). The temperature during the process is preferably −15 to −5° C., more preferably −10° C. when water is used as the solvent. The pressure is maintained at this steady state while the frozen water in the mixture is removed from the mixture by sublimation (i.e., direct conversion of solid to gas). The period of time required to remove water by sublimation depends upon the batch size being processed. As an example, a 0.5 liter volume of frozen mixture containing 50 grams of propellant solute requires approximately 100 hours to remove the water, depending upon the pumping speed of the vacuum system. After removal of the water is complete, as indicated by a rapid drop in the steady-state pressure to a value near the base pressure of the vacuum container (i.e., $10^{-5}$ Torr or lower), the material consists of low-density, dry agglomerates of a metal fuel particles distributed generally uniformly throughout a matrix of the oxidizer.

Freeze drying techniques have been utilized to facilitate mixing of the solid rocket propellant components. One prior art method concerns a low shear mixing process for preparing rocket propellants. The propellant ingredients are blended with an inert diluent to reduce the high shear mixing environment generated by conventional mixing techniques. Once thus mixed, the diluent is removed by sublimation from the mixture via a freeze drying process. While this method does facilitate the mixing of high solids propellants, the individual components, i.e., the oxidizer and metallic fuel, still comprise discrete particles. Thus, the problems of achieving a homogeneous mixture inherent in mixing discrete oxidizer and metallic particles are still present in this method.

In preferred methods, freeze drying techniques are used to prepare ultrafine particles comprising metallic particles generally uniformly dispersed in a matrix of solid oxidizer, thereby eliminating the problems inherent in the use of discrete metallic fuel particles and solid oxidizer particles. The freeze drying method used in accordance with preferred embodiments involves forming a generally uniform dispersion of metal particles in the solution of solid oxidizer. Water is a preferred solvent because it will dissolve a wide range of solid oxidizers, many of which are ionic solids. Of the ionic solid oxidizers, ammonium perchlorate is preferred because of its good solubility in water.

Once the solution is prepared and the solid particles are generally uniformly dispersed in solution, it is rapidly cooled to freeze the solution and fix the spatial distribution of particles throughout the solution. Any suitable cooling and freezing method may be used, but preferred methods involve immersing the solution in a cryogenic liquid, e.g., liquid nitrogen. The frozen liquid is then transferred to a vacuum chamber where solvent is removed by sublimation. This method works well with nanoaluminum since the metal is sufficiently non-reactive at cryogenic temperatures. In addition, the method is particularly well suited for use with nanoaluminum since nanometer-sized particles remain suspended in the solvent for a period of time than do micrometer-sized particles. This feature enables the nanoaluminum mixture to be rapidly frozen without undue settling of the aluminum particles to the bottom of the freezing volume, with little or no agitation required during freezing. Nanometer-sized particles form a pseudo-colloidal suspension with the solvent, whereas micron-sized particles rapidly settle out of the mixture unless continuous agitation is applied during freezing.

EXAMPLE 1

Preparation of AP/Aluminum Nanoparticle Matrix (NRC-1)

Ammonium perchlorate (0.5 gram, 99.9% pure, Alfa Aesar stock #11658) was dissolved in 10 milliliters of deionized water to form a solution having a concentration of approximately 0.4 moles/liter. In this step, the specific concentration achieved is not critical as long as the solution is well below the saturation point of 1.7 moles/liter at 25° C., to ensure that all of the ammonium perchlorate dissolves. To this solution was added 0.5 gram of nanoaluminum of average particle diameter 40 nm. The quantities of ammonium perchlorate and nanoaluminum were selected so as to yield a stoichiometric ratio of the ammonium perchlorate to the unoxidized aluminum in the nanoaluminum particles. The mixture was agitated by mechanical shaking to ensure that the particles were completely immersed and that the mixture was substantially homogeneous. The mixture of nanoaluminum particles in ammonium perchlorate solution was then rapidly frozen by pouring the mixture into a container of liquid nitrogen. The container of liquid nitrogen and frozen mixture was then transferred to a vacuum container capable of achieving a base pressure of $10^{-5}$ Torr or lower in order to achieve low enough pressure to achieve rapid freeze drying. The vacuum system used was a custom pumping station using a Varian VHS-6 oil diffusion pump, a Leybold-Heraeus TRIVAC D30A roughing/backing pump, and a 16-inch diameter×18-inch tall stainless-steel bell jar. Active pumping on the vacuum container was immediately initiated after pouring the agitated mixture into the liquid nitrogen. After a period of 10 minutes, the pressure in the system achieved a steady-state pressure, stabilizing near the equilibrium vapor pressure of the frozen water, i.e., $10^{-3}$ Torr. The pressure was maintained at this steady state while the frozen water in the mixture was removed from the mixture by sublimation. After an hour removal of the water was complete, as indicated by a rapid drop in the steady-state pressure to a value near the base pressure of the vacuum container (i.e., $10^{-5}$ Torr or lower). The resulting material consisted of about 1 gram of low-density, dry agglomerates of ammonium perchlorate/nanoaluminum matrix (labeled NRC-1).

EXAMPLE 2

Preparation of AP/Aluminum Nanoparticle Matrix (NRC-2)

Ammonium perchlorate (5 grams, 99.9% pure, Alfa Aesar stock #11658) was dissolved in 100 milliliters of deionized water to form a solution having a concentration of approximately 0.4 moles/liter. As explained earlier, the specific concentration achieved is not critical as long as the solution is well below the saturation point of 1.7 moles/liter at 25° C., to ensure that all of the ammonium perchlorate dissolves. To this solution was added 5 grams of nanoaluminum of average particle diameter 40 nm. The quantities of ammonium perchlorate and nanoaluminum were selected so as to yield a stoichiometric ratio of the ammonium perchlorate to the unoxidized aluminum in the nanoaluminum particles. The rest of the procedure was identical to that stated above in Example 1, except that the time required for complete removal of water was 14 hours. The resulting material consisted of about 10 grams of low-density, dry agglomerates of particles of ammonium perchlorate/nanoaluminum matrix (labeled NRC-2).

EXAMPLES 3 AND 4

Preparation of AP/Aluminum Nanoparticle Matrix (NRC-3 and NRC-4)

Two 50 gram batches of ammonium perchlorate/nanoaluminum matrix were sequentially prepared, each by dissolving 25 grams of ammonium perchlorate (0.5 gram, 99.9% pure, Alfa Aesar stock #11658) in 0.5 liters of deionized water to form a solution having a concentration of approximately 0.4 moles/liter. As in the previous examples, the specific concentration achieved is not critical as long as the solution is well below the saturation point, to ensure that all of the ammonium perchlorate dissolves. To this solution was added 25 grams of nanoaluminum of average particle diameter 40 nm. The quantities of ammonium perchlorate and nanoaluminum were selected so as to yield a stoichiometric ratio of the ammonium perchlorate to the unoxidized aluminum in the nanoaluminum particles. For both batches, the rest of the procedure was identical to that stated above in Example 1, except that the time required for complete removal of water for each batch was 120 hours. It is likely that the time required for water removal can be shortened to some extent by modifying the pouring process to yield a frozen mass of high surface area; i.e., thin, flat frozen masses as opposed to a single monolithic lump of frozen material. Small, thin frozen masses are expected to dehydrate more quickly during freeze drying than a single, monolithic mass of equivalent weight due to the larger surface area that is exposed by having many small masses relative to the surface area of a single large mass. The resulting processed material of each batch consisted of about 50 grams of low-density, dry agglomerates of particles of ammonium perchlorate/nanoaluminum matrix (labeled NRC-3 and NRC-4, respectively). Because of the great similarity or identity between the two materials, NRC-3 and NRC-4 are used interchangeably throughout this description.

Burn Characteristics of Oxidizer/Metallic Fuel Matrix

To test the burn characteristics of the oxidizer/metal matrix, the burn rates of the loose powders prepared in Examples 1–4 were determined. The loose powder burn rate test utilizes a reaction velocity measurement apparatus consisting of a trough, a hot bridge wire at one end of the trough, and a photo sensor at each end of the trough. The loose powder, preferably 150 mg or more, is evenly distributed along the length of the trough which measures nominally 0.0625" deep, 0.0625" wide, and 1.0 " long. As the burn front of the ignited powder in the trough passes the first photo sensor, an output signal is produced from the photo sensor. The burn front moves along the trough, eventually crossing the second photo sensor, producing a second photo sensor output signal. The output signals from the two photo sensors are recorded simultaneously. The burn rate is calculated by dividing the distance between the two photo sensors by the lapsed time between the two photo sensor output signals.

It should be noted that loose powder burn rate testing is not a standard test for rocket propellants, as rocket propellants are normally used at high density, not as loose powder. Thus, standard burn rate tests for rocket propellants are usually performed at high density, usually as a function of gas pressure in a confined testing chamber. Loose powder propellant burn rates are typically 10,000 (or more) times faster than high-density burn rates. Nevertheless, loose powder burn rate measurements can be used as a rapid evaluation tool during process development, as we have done here. Later in our discussion, we present results of standard, high-density burn rate tests for a specific propellant formulation that uses the materials from Examples 3 and 4 as components in the formulation.

EXAMPLE 5

Loose Powder Burn Rate Testing

The loose powder burn rate testing was done as follows. A loose powder sample of 0.15 to 0.2 grams, preferably 0.15 grams was placed into the 1 inch long trough of the reaction velocity measuring apparatus. Photo sensors 1 and 2 were located about 1.8 cm apart in the middle section of the trough. The powder was ignited by a hot bridge wire at one end of the trough. Output signals from the photo sensors were recorded simultaneously. As the burn front passed each photo sensor, an output signal was produced. The time required for the burn to travel the distance between the two photo sensors is determined from the recorded output signals, and the burn rate was calculated by dividing the distance between the photo sensors by the time.

Loose powder burn rates for the NRC-1, NRC-2, NRC-3, and NRC-4 samples were measured using the procedure above. The masses tested and the results of those measurements are tabulated below.

TABLE 2

Loose Powder Burn Rate Test

| Sample | Amount Tested (g) | Loose Powder Burn Rate (in/sec) |
|---|---|---|
| NRC-1 | 0.15 | 36,000 |
| NRC-2 | 0.15 | 45,000 |
| NRC-3 | 0.15 | 49,000 |
| NRC-4 | 0.15 | 53,000 |
| NRC-1 (2 weeks old) | 0.15 | 50,000 |

To determine if the loose powder burn rate performance degrades over time, a two week old sample of the NRC-1 powder was subjected to the loose powder burn rate test as described above. As can be seen from the table above, no measurable performance degradation was observed.

Energy Considerations of Propellants

In view of current propellant technology, there exist needs for improved performance. One means by which solid rocket propellants can deliver improved performance is by maximizing the high-energy output solids component of the propellant formulation. One method of achieving this maximization is by minimizing the low-energy binder component. The energy released in the reaction of Al with AP is 2.4 kcal/g, as stated earlier. The energy released in the reaction of AP with binder is much lower. For example, in the reaction of the common binder hydroxy-terminated polybutadiene (HTPB) with AP, the balanced thermochemical reaction is $$28\ C_{73}H_{110}O_6 + 574\ NH_4ClO_4 \rightarrow 287\ H_2 + 574\ HCl + 2044\ CO + 2401\ H_2,$$

with an associated energy release of 0.36 kcal/g. Thus, where the portion of the binder and its corresponding AP in the propellant represents 38 wt. %, the overall energy release for the final propellant formulation is 1.6 kcal/g. Therefore, even a small percentage reduction of the binder content can result in significant improvements in energy output. As a result, more payload can be propelled by the same weight of propellant. Alternatively, less propellant is required to propel the same payload. This, in turn, allows the motor to be reduced in size, resulting in increased propulsion efficiency. Therefore it is often desirable to provide a solid rocket propellant wherein the binder content is minimized.

Means for reducing the binder content include increasing the particle size of the AP component to as much as 200 microns, thus decreasing the surface area to be wetted by the binder. While the standard particle size of AP is 30 microns, it ranges from 3 to 200 microns in various formulations. However, this increased particle size may result in a corresponding undesirable decrease in power or burn rate, as discussed elsewhere herein. Therefore, a means of decreasing binder content without increasing AP component particle size is desirable.

Another approach toward producing propellants of greater efficiency is to use as the metallic fuel metals with a lower average atomic weight than the currently used aluminum fuel. These fuels include such fuels as lithium, beryllium and boron. It would thus be desirable from a propulsion efficiency standpoint to produce a solid rocket propellant that could effectively utilize low atomic weight metals.

The compositions of the present invention find utility in a wide variety of applications, including primer mix for ammunition, and in gas generators such as are used in automobile air bags and ejector seat mechanisms. One especially preferred use for the compositions is as solid rocket propellants. In this use, the compositions of the present invention allow for the production of propellants which are capable of delivering the improved performance over compositions in the prior art.

As mentioned above, very few advances have been made in solid propellants over the last few decades. As other portions of standard launch vehicles have increased in complexity and performance, propellants have lagged behind. Therefore, in accordance with one aspect of the present invention there is provided advanced propellants which provide higher burn rates and greater power to the motor in which they are used.

After achieving the remarkable results of the loose powder burn tests above, one formulation, NRC-4, was used to make propellants which were compared against more conventional propellant formulations. The propellants were made by mixing the components, present in stoichiometric quantities, such as by using a mortar and pestle, rotary mixer, planetary mixer, grinder, or other suitable mixing apparatus or means for mixing solids and/or solids and liquids such as are known in the art. The hydroxy-terminated polybutadiene (HTPB) in the propellant formulations was used neat, without a curing agent, such that the propellant could be loaded into the test motor immediately after mixing and burned thereafter, without having to wait for the material to cure, although it was not a necessity that the loading and testing be done immediately following mixing. Additionally, burn rate catalyst was not added to the propellant mixtures tested herein.

In some embodiments, one or more components may be present in a quantity or form that makes it difficult to achieve sufficient mixing. For example, in several embodiments of propellant mixtures disclosed herein, the liquid HTPB is present in an amount so small that it cannot wet all the particles of the fuel or fuel/oxidizer composition (e.g. NRC-4), such that traditional binder mixing methods are not able to achieve a mixture with fairly consistent composition throughout the mixture. In such cases, one may achieve a reasonably consistent propellant mixture by use of a solvent. The HTPB (or other such component) is first dissolved in a solvent. The solvent is chosen for its compatibility with one or more of the components of the mixture, such as miscibility with a component or ability to dissolve a component. Preferred solvents will not substantially react with the metal fuel or other components of the propellant mixture. For propellant compositions comprising aluminum, AP and HTPB, preferred solvents include nonpolar solvents such as hexane or pentane. The components are mixed with the solvent. The order of addition to the solvent is not critical. The mixture, in the solvent, is then agitated, stirred, sonicated, or otherwise mixed. The solvent is then removed by evaporation, such as in open air, under reduced pressure, with application of heat or other method as is known in the art. As such, solvents having a low boiling point or high vapor pressure are preferred.

EXAMPLE 6

Preparation of Propellant Mixture

A small-scale, 1-gram batch of propellant was prepared by dissolving 0.047 gram of HTPB into 15 ml of reagent grade hexane in a capped, cylindrical glass container of approximately 25 ml volume. To this solution, 0.103 gram of AP (3-micrometer particle size) was added, followed by 0.85 gram of NRC-3. The resulting mixture was sonically mixed for about 10 minutes. The hexane was removed by evaporation in air with warming to about 40 C., to leave a solid propellant material.

Propellant Burn Rate and Pressure Exponent

It is well known in the propellant industry that propellants generally burn faster at higher pressure. The behavior is usually described by the formula $$R_b = C\,P^n,$$

where $R_b$ is the burn rate, C is a constant, P is pressure, and n is the pressure exponent. It is further widely known in the industry that the value of the pressure exponent for a candidate propellant is critical to the utility of the propellant in rocket motors. In particular, if the value of the pressure exponent for a candidate propellant is 1 or greater, the candidate propellant is unsuitable as a rocket propellant, as the burn rate will increase uncontrollably as pressure builds and will thus lead to an explosion. On the other hand, if the exponent is 0.6 or lower, the candidate propellant will be relatively stable in typical rocket motor environments.

The burn rate and pressure exponent of the propellant produced in Example 6 was determined by measuring the burn rate at high density at various pressures by pressing the propellant into pellets and measuring the burn rate in a sealed pressure vessel at various applied pressures. Several high-density pellets were formed from the propellant mixture of Example 6 by pressing nominally 0.080 grams of the propellant mixture for each pellet into a cylindrical volume measuring 0.189 inches in diameter and approximately 0.1 inches long, using a hydraulic press and stainless steel die assembly. A density of approximately 1.7 grams per cubic centimeter was obtained by applying a force of 400 pounds to the die. A free-standing, cylindrical pellet, thus formed, was removed from the die by pushing the pellet out of the die.

The burn rate of a free-standing pellet can be measured by burning the pellet in a confined volume and measuring the pressure rise as a function of time in the volume. As the pellet burns, the product gases formed by the propellant will cause the pressure in the confined volume to increase until the burn is complete. By measuring the length of the pellet before the burn and measuring the time interval during which the pressure increases during the burn in such a volume, the average burn rate of the propellant can be calculated by dividing the pellet length by the time interval that the pressure was increasing. Performing such measurements with the confined volume pre-pressurized with a non-reactive gas (e.g., dry nitrogen) yields burn rates at elevated pressures that can be used to calculate the pressure exponent for the propellant.

EXAMPLE 7

Burn Rate Testing and Pressure Exponent Determination of Propellant Mixture

Three pellets fabricated from the powder prepared in Example 6, as described above, were separately burned in a stainless steel pressure vessel of 350 cubic centimeters, to determine burn rate and the burn rate exponent for the propellant mixture. The pressure vessel contained a pressure transducer (Endevco, 500 psig) and two electrical connectors to which a hot wire ignitor (nichrome wire, 3 inches long by 0.005 inches in diameter) was attached. In each of separate tests, the ignitor wire was first taped to the flat bottom of the pellet, the ignitor wire (with pellet) was attached to the electrical connectors inside the pressure vessel, and the vessel was sealed. The pellet was ignited by passing a 3-amp DC current through the electrical connectors, causing the ignitor wire to heat and ignite the propellant. Pressure in the vessel was recorded as a function of time by measuring the electrical output of the pressure transducer with a digital oscilloscope (Tektronix, model TDS460A). One of the pellets was burned at the ambient atmospheric pressure of the laboratory. The other two pellets were burned after pre-pressurizing the vessels with dry nitrogen to 125 and 300 pounds per square inch, respectively. Pellet weight, pellet length, pellet density, burn time, and average pressure during the burn for the three pellets are shown in Table 3.

TABLE 3

High-Density Burn Rate Results

| Weight (g) | Length (in.) | Density (g/cc) | Time (sec) | Burn Rate (in/sec) | Pressure (psig) |
|---|---|---|---|---|---|
| 0.060 | 0.080 | 1.63 | 0.0286 | 2.80 | 16.6 |
| 0.080 | 0.107 | 1.63 | 0.0132 | 8.11 | 167.5 |
| 0.085 | .112 | 1.65 | 0.0111 | 10.08 | 338.1 |

A least-squares polynomial fit of the data in Table 3 reveals that the burn rate for this propellant varies as $$R_b=(0.8374)p^{(0.4337)},$$

Where Rb is burn rate in inches per second and P is pressure in pounds per square inch. The pressure exponent, n, for this propellant mixture is approximately 0.43 (i.e., n<0.6), suggesting the mixture should be acceptable for rocket motor applications, from a pressure-dependence perspective.

It has been recognized that if one decreases the particle size of a material, then the surface area in a fixed volume or mass of that material increases. Smaller particle sizes decrease the distance between particles, and thereby increase the velocity of the burn rate and the power obtained by burning the material because of the reduction in reactant diffusion distance. However, by decreasing the particle size of the fuel or fuel/oxidizer composition in a propellant formulation, the amount of binder required to cement all of the particles together would increase due to the increased surface area. If, however, more binder is used, the final propellant formulation will be of lower energy because of the increased quantity of binder, a low energy fuel. Therefore, in accordance with one embodiment of the present invention, use of additional binder can be avoided by binding or pressing together particles of the fuel/oxidizer matrix into one or more "macroparticles" which, depending upon the size particle desired, may be re-separated into smaller macroparticles. By compressing powder into larger, mechanically stable macroparticles, surface area of the homogeneous fuel/oxidizer matrix composition of the present invention is reduced and less binder is needed to consolidate particles into solid mass. Such macroparticles can be wetted by the binder without increasing the amount needed over that needed in conventional solid rocket propellant mixtures.

Macroparticles of powder comprising particles of fuel/oxidizer matrix can be prepared by pressing or compacting the loose powder into pellets. Other suitable methods for consolidating the particles may also be used, e.g., thermal or chemical sintering. The pellets are then broken up into appropriately-sized macroparticles. Preferred macroparticles may be on the order of a few microns to several hundred microns in diameter. For example, macroparticles may be made which are approximately 30 microns or 200 microns, which are approximate sizes of commonly-used metal fuel and oxidizer particles in conventional solid rocket propellant formulations. The formation of macroparticles aids in mixing the NRC-4 with propellant components having a larger particle size than the NRC-4, because homogeneity is more easily approximated in a mixture of similarly sized particles than in one with particles of differing sizes. As such, in accordance with one embodiment of the present invention, there is provided a propellant comprising macroparticles and a binder/oxidizer mixture, wherein the macroparticles are an agglomeration of smaller particles of a composition comprising a substantially homogeneous mixture of fuel particles distributed throughout a matrix of an oxidizer.

EXAMPLE 8

Preparation of 100–250 μm Macroparticles

Macroparticles of NRC-4 powder were prepared by compressing the powder into solid, flat pellets using a laboratory press. The pellets thus produced were ground into smaller pieces using a mortar and pestle. Macroparticles ranging in diameter from 100 microns to 250 microns were separated out by sifting the macroparticles through two sieves atop each other. The first sieve had 250 micron openings and the second sieve had 100 micron openings.

In order to compare propellant formulations of the present invention, both to each other and to the prior art, a simple laboratory scale test was devised. The propellant compositions tested were made according to the solvent-based method described above. The test allows for the measurement of properties relevant to the performance of a propellant, such as burn rate, average thrust, and Isp (Propulsion Potential). The test provides for the measurement of weight (force) and time while the propellant is being burned in a mini-motor. Because some properties may be dependent in part upon factors including the size and/or aspect ratio of the motor, particular motor configurations were chosen for use in the tests. One configuration chosen for the mini-motor was a stainless steel tube having an internal diameter of 0.19 inches and an aspect ratio of about 12:1 (length to internal diameter). Another series of tests were done using the same 0.19 inch ID stainless steel tubing in which the aspect ratio was about 5:1.

To perform the test, a section of the 0.19 inch ID stainless steel tubing was cut to a length (within about 5%) to provide a motor having the desired aspect ratio for that series of tests, and filled with propellant to make the motor. The filling was done by placing the propellant into the tube, and then tamping or packing it down into the tube, first by hand and then by means of a laboratory press. A sleeve was placed on the tube to provide balance and support, which was then placed on an electronic balance and zeroed. The motor was then ignited and the mass or force, in grams, was measured as a function of time. From these data points, the mass of propellant, burn time, burn rate average thrust and Propulsion Potential were be calculated.

The tests comparing two NRC-4 containing propellant formulations to three more conventional propellant formulations were performed as discussed above, and used mini-motors having an aspect ratio of approximately 5:1 (length to internal diameter). The results of the tests are set forth in Tables 4 and 5 below.

TABLE 4

NRC-4 Propellants in the 5:1 Mini-Motor

| | Composition | Propellant (g) | Burn rate (in/sec) | Burn Time (sec) | Average Thrust (g) | Propulsion Potential (Isp) (sec) |
|---|---|---|---|---|---|---|
| 1 | 65% NRC-4; 11.1% HTPB; 23.9% 3 μ AP | 0.574 | 0.395 | 1.98 | 5.814 | 20.1 |
| 2 | 60% NRC-4; 12.6% HTPB; 27.4% 3 μ AP | 0.564 | 0.373 | 1.86 | 5.901 | 19.5 |

TABLE 5

Conventional Propellants in the 5:1 Mini-Motor (no intimate mixing of Al/AP)

| | Composition | Propellant (g) | Burn rate (in/sec) | Burn Time (sec) | Average Thrust (g) | Propulsion Potential (Isp) (sec) |
|---|---|---|---|---|---|---|
| 3 | 19% 30 μ Al; 69% 200 μ AP; 12% HTPB | 0.935 | 0.030 | 38.56 | 0.025 | 1.0 |
| 4 | 19% 5 μ Al; 69% 3 μ AP; 12% HTPB | 0.662 | 0.059 | 17.52 | 0.057 | 1.5 |
| 5 | 19% 3 μ Al; 69% 3 μ AP; 12% HTPB | 0.630 | 0.064 | 15.82 | 0.098 | 2.5 |

Much of the discussion presented herein is in terms of burn rate. This is because the burn rate of a material is highly indicative of its properties and suitability as a propellant. However, for experimental purposes, one generally uses the specific impulse (Isp) for comparison. The Isp takes the amount of the propellant material tested into account, thus allowing for a direct comparison between the various formulations and tests for which there may be slight differences in the quantity of the material used.

It should be noted herein that the data presented in Tables 4 through 7 for the propellant formulations are values that were measured when the propellant was combusted under a very low, near ambient pressure. No nozzle or other flow restrictor was placed on the tubes during burning, nor was there any other method used to increase the pressure of the material during combustion. This differs from the general practice in the aerospace industry, wherein Isp values are generally measured at a pressure of 1000 psi and reported as such, oftentimes without indication that such elevated pressure was used. If the pressure is increased, one expects the burn rate to increase, which would lead to an increase in measured Isp due to the relation between the two properties. Therefore, in the discussion which follows the measured Isp at near-ambient pressures will be termed "Propulsion Potential" to avoid confusion with and distinguish from the industry-standard high pressure Isp measurements.

Table 4 presents the results of tests on two propellant formulations of the present invention using NRC-4 powder. The amount of AP listed in the composition is the stoichiometric amount of AP for the HTPB present, that is the amount of AP needed to react the HTPB only. The NRC-4, as discussed supra includes AP in a quantity sufficient to react with all the aluminum component thereof. Table 5 presents the results of tests on three more conventional propellant formulations in which the components as listed are micron-sized and are mixed together and cast into the tubes without curing. The AP listed in the formulations of Table 5 is the stoichiometric amount for both the Al and HTPB present. The formulations in Table 5 do not comprise the intimate, homogeneous mixtures of aluminum and AP of the compositions of the present invention, including NRC-4. All compositions in both tables, however, have about 12% HTPB. All percentages herein are by weight.

The results of Table 5 demonstrate the effect of particle size, and thus reactant diffusion distance, as discussed herein. Formulation 3, comprising 30μ Al and 200μ AP has the largest particle sizes, followed by formulation 4 having 5μ Al and 3μ AP, and finally by formulation 5 having 3μ Al and 3 μAP. It can be seen from Table 5 that the Propulsion Potential increases as the particle size decreases, indicating that the lower particle size formulations would provide more powerful fuels.

An additional factor which may be at work is the difference in the particle sizes. In formulation 3, the AP particles are, on the average, about 6–7 times larger than the Al particles. In formulation 5, the particles of Al and AP have the same average diameter. The size difference between the particles in formulation 3 would make sufficient mixing of the fuel and its oxidizer difficult, which could also, or alternatively, account for its lower Propulsion Potential and lower burn rate.

Comparison of the data in Table 4 to formulation 5 in Table 5 shows that the Propulsion Potential is increased about 8-fold when the fuel and its oxidizer is in the form of an intimate, substantially homogeneous mixture of nanoaluminum and AP according to a preferred embodiment (NRC-4) of the present invention. In these formulations, the NRC-4 provides small fuel particle size, on the order of about 40 nm, as well as low reaction diffusion distance because the nanoaluminum is dispersed throughout the AP oxidizer phase in a substantially uniform fashion. In preferred embodiments of fuel/oxidizer matrix compositions, such as NRC-4 and similar compositions comprising larger, micron-size fuel particles, the concerns regarding obtaining a homogeneous mixture of fuel and oxidizer seen in formulation 3 are minimized, because the composition itself, having the fuel particles dispersed throughout the oxidizer phase provide a mixture which is substantially homogeneous, intimate, and of the correct stoichiometry.

Thus, it can be seen that the propellants comprising compositions of the present invention have very high energy, power, and burn rate as compared to propellants comprising more standard-like particle mixes.

Another effect seen in comparison of the results for formulations 1 and 2 has to do with the quantity of HTPB, a low energy fuel, which is present. Formulation 1 having a lower amount of HTPB than formulation 2, has a higher Propulsion Potential as compared to formulation 2. The effect of the relative amounts of low energy fuel and high energy fuel are discussed in greater detail below.

To understand how to optimally increase burn rate in a multiple-component propellant, it is useful to examine how the burn rates and physical dimensions of the individual components contribute to the overall burn rate. Consider, for example, a typical multiple-component, high-burn-rate solid rocket propellant formulation that consists of: 68 wt % ammonium perchlorate (AP) in a trimodal particle size distribution (24 wt % 200 μm-diameter, 17 wt % 20 μm-diameter, 27 wt % 3 μm-diameter), 19 wt % aluminum (Al, 30 μm average particle diameter), 12 wt % binder (HTPB resin+IPDI curing agent) and 1 wt % "burn-rate catalyst" (e.g., $Fe_2O_3$ powder).

The relative amounts of the components in a propellant formulation should be chemically stoichiometric, independent of the particle size. That is, there are just enough oxidizer molecules present in the formulation to completely react with all of the fuel molecules that are present, with no excess of either oxidizer or fuel, regardless of whether those molecules are in particles having a diameter of 50 nm, 3μ, or 200μ. It is important to realize that, in the formulation shown above, there is a single oxidizer and two distinct fuels. The oxidizer is AP and the fuels are aluminum and HTPB. For the purpose of this discussion, we will ignore any contribution from the burn-rate catalyst. We assume that the catalyst contribution to the overall burn rate is negligible relative to the other effects that will be discussed.

One key to understanding burn-rate phenomenon in this formulation is to realize that the formulation consists of a mixture of low-energy propellant and a high-energy propellant. Specifically, the low-energy (low burn rate) propellant is AP+HTPB and the high-energy (high burn rate) propellant is AP+aluminum.

Given that the formulation contains 12 wt % HTPB, the amount of AP that is required for a stoichiometric reaction of AP with HTPB is 26 wt %. The remaining 46 wt % AP is stoichiometric for the high-energy reaction of AP with aluminum. To maintain correct chemical stoichiometry in any formulation involving HTPB or other low energy component, the weight ratio of HTPB to AP available to react with the HTPB should be maintained at about 12/26, regardless of any other components that may be added. This requirement ensures that the correct ratio of oxidizer and fuel molecules are present such that there is no excess oxidizer or fuel molecules present in the propellant mixture during the burn.

When a propellant formulation comprises two propellant components, a fast-burning propellant component and a slow-burning propellant component, it will burn at a rate that is dramatically limited by the burn rate of the slow-burning propellant. As the burn front progresses through a matrix of multi-component propellant particles, a particle of fast-burning propellant will burn rapidly, advancing the burn front rapidly. Conversely, when the front reaches a slow-burning propellant particle, the front burns slowly through that particle. The overall burn rate can be viewed as a result of burning through fast-burning and slow-burning particles sequentially. Important features of the overall burn phenomenon are revealed by considering a one-dimensional model that consists of a region of fast-burning propellant in series with a region of slow-burning propellant. The burn rates of the fast-burning and slow-burning propellants are $R_f$ and $R_s$, respectively. Linear distances through the fast-burning and slow-burning propellants are $d_f$ and $d_s$, respectively. Total length of the two component propellant strip is:

$$d_{total}=d_f+d_s,$$

and the time required to burn the entire strip of two-component propellant is $$t=d_f/R_f+d_s/R_s.$$

Then the overall burn rate for the strip of two-component propellant is:

$$R = d_{total}/t = \frac{(d_f+d_s)}{d_f/R_f+d_s/R_s} \quad \text{(Eq. 1)}$$

Equation 1 is useful in exploring the effects of relative lengths (i.e., relative propellant amounts) and relative burn rates between the two propellant components in a two-component formulation. For example, if the burn lengths (amounts of propellant) are equal, i.e., $d_f=d_s=d$ and if one propellant burns twice as fast as the other, $R_f=2R_s$, the overall burn rate is $$R=2d/(d/2R_s+d/R_s,)=3/2R_s,$$

or 1.5 times the burn-rate of the slowest component.

If, however, one were to calculate the burn rate of a propellant in which the fastest component burns infinitely fast, then Eq. 1 shows that $$R=2\ R_s.$$

That is, the overall burn rate of the formulation will only be twice as fast as the slowest component, even when the fastest component burns instantaneously. This is an absolute upper limit for formulations with equal amounts (propellant burn distances) of low-and high-rate components. This result warrants careful consideration in designing dual-component propellant formulations with high burn rates.

To appreciate the result of Equation 1, consider that an overall burn rate of 10 inches/second is desired. If a low burn-rate propellant component that burns at 2 inches/second were combined with a high burn-rate component, certain ratios of low-rate to high-rate components can never reach an overall burn rate of 10 inches/second, no matter how fast the high-rate component burns. The limiting ratio can be determined using Eq. 1 by assigning infinity as the burn rate for the high-rate component $R_f$; i.e., $$10\text{in/sec} = \frac{d_f/d_s+1}{((d_f/d_s)/R_f+1/(2\text{in/sec})} = (d_f/d_s+1)/0.5\text{in/sec},$$

therefore $d_f/d_s=(0.5)(10)-1=4$. Thus, if $d_f/d_s$, is less than 4 (i.e., the high-rate component is less than 80% of the formulation), it is impossible to achieve an overall burn rate of 10 in/sec, no matter how fast the high-rate component burns.

To further appreciate the significance of this, consider a dual-component formulation that uses a fast-burning propellant that is 100 times faster than the slow-burning propellant component, and uses 100 times more fast-burning propellant than slow-burning propellant. In this case, $d_f=100\ d_s$ and $R_f=100\ R_s$, then $$R=(100d_s+d_s)/(100d_s/100R_s+d_s/R_s)=101/2\ R_s=50.5R_s.$$

This result is considerably lower than one might have intuitively guessed at the onset and illustrates how only a small amount of slow-burning component can dramatically limit the overall burn rate. In this case, only 1% of slow-burning propellant in the formulation limits the burn-rate to half the value of the fast-burning propellant burn rate.

The above discussion is in terms of a two-component mixed propellant, similar relations can be derived for three- and more component mixed propellants. Limiting the discussion above to two components is for the sake of simplicity only, and should not be considered a limitation on the propellant formulations of the present invention, which may comprise one, two, three, or more different fuels (or fuel/oxidizer propellants). Furthermore, the relative distances ($d_s$, and $d_f$) in Equation 1 (or any related equation for three or more components) are approximately equivalent to the relative amounts of the materials ($m_s$ and $m_f$). Thus, Equation 1 can be rewritten in terms of the masses or weights of the components as follows:

$$R = m_{total} / t = \frac{(m_f + m_s)}{m_f / R_f + m_s / R_s} \quad \text{(Eq. 2)}$$

Therefore, by knowing the individual component burn rates, one can derive the relative amounts of the fast and slow propellants needed to create a formulation of mixed propellant to achieve the selected value of R (overall burn rate). Because this equation is based upon several assumptions, the results regarding rates or formulations may vary slightly from those calculated using the either Equation 1 or 2. In some circumstances, it may be desirable to optimize the formulation calculated using the equation above. Techniques involved in optimization of propellant formulations are known to those skilled in the art, and may be adapted to suit the propellant formulations of the present invention in view of, and with the aid of the disclosure herein.

The above discussion shows that one method of obtaining a substantial burn rate increase in a dual-component propellant comprising a fast-burning component and a slow-burning component is to limit the amount of slow-burning component to very small values. Conversely, it also demonstrates that the burn rate of a very high burning propellant can be reduced by the addition of a lower burning component. By using a relation such as Equation 1, the degree of reduction can be "tuned" to fit a particular application or use, dependent upon the amount of low burning component added and the difference in burn rate between the high and low burning components.

For example, if one wanted to reduce the burn rate of a material by a factor of two, one could either add a relatively small amount of a very low burn rate material, or a larger quantity of a material having a moderate burn rate, albeit one lower than the "fast burning" material. For example, if a fast burning propellant had a burn rate of 100 in/sec, a mixed propellant would need to comprise only 2% of a propellant having a burn rate of 2 in/sec to reduce the burn rate by half. On the other hand, if the "slow" propellant had a burn rate of 20 in/sec, the final mixed propellant would have to contain 25% of the slower burning component to achieve the same reduction in burn rate.

Thus, although for many applications, a relatively low burn rate material such as HTPB may be preferred due to its low cost, availability, and well-understood properties, use of "intermediate" low burn rate propellants may be preferred for other applications and purposes. Intermediate low burn propellants as is used herein are those having burn rates somewhat higher than the very slow materials but still lower than the high burn rate propellant used. For example, when an intermediate low burn rate material is used, slight errors in measuring or mixing will not have as large of an effect on the properties of the final propellant as will a similar error or variation with a very low burn rate propellant because each gram of an intermediate low burn rate propellant has a lower net effect than each gram of a very low burning low burn rate propellant, as shown above. Also, because of the intermediate low burn rate propellant provides a somewhat moderated effect as compared to very low burn rate propellant, it may be easier to achieve more subtle changes in the burn rate of a high burning propellant by using smaller quantities of an intermediate low burn rate propellant in a mixed propellant.

In accordance with another aspect of the present invention, there is provided a method which allows the skilled artisan to make a propellant having particular desired characteristics, including burn rate and energy output, by altering the composition and/or content of the propellant in accordance with the disclosure herein. Some of the propellants and methods disclosed below, are described in relation to a preferred fuel and oxidizer composition, NRC-4, disclosed supra, comprising an intimate mixture of a stoichiometric ratio of ammonium perchlorate and nanoparticulate aluminum. The discussion is also in terms of adding components to slow the burn rate of the NRC-4 material. The disclosure and discussion has been thus limited for means of simplicity and comparability of results, and should not be construed as limiting the scope of the invention to the particular composition discussed. Instead, the invention includes application of these same methods and principles to all fuel/oxidizer compositions of the present invention, as disclosed above, including those comprising different quantities of materials or different particle sizes. Furthermore, the same principles discussed herein, albeit reversed, would apply if one were starting with a lower burn rate material and wished to increase the burn rate.

Although a very high burn rate nanofuel based composition as described above is useful for many applications, for some applications it may be desirable to use a propellant that burns at a slower rate providing thrust over a longer period of time at a lower level, achieving slower speeds and/or less rapid acceleration. For example, some launch vehicles may have sensitive guidance systems, or they may carry delicate payload or have humans or other animals inside. In such cases, it may be preferable to use a motor having a moderate burn rate to avoid possible damage to the payload, passengers, or guidance systems that may come from rapid acceleration.

One method of achieving a propellant with particular burn rate and thrust characteristics is to add one or more slower burning components to the higher burn rate material. A slower burn rate component may be any fuel which burns at a slower rate, along with the amount of oxidizer necessary to burn the slower burning fuel. Preferred slower burn rate components include metal fuels having a larger particle size than that in the higher burn rate fuel composition, and compositions comprising slower burning fuel metals. In other preferred embodiments, HTPB may be used as the slow-burning component. Similarly, other materials commonly used as binders in conventional CP rocket fuel, such as carboxy-terminated polybutadiene (CTPB) and other combustible polymers or compounds may also be used.

This amount of low burn rate and high burn rate propellant may be determined experimentally by preparing mixed propellants and testing them in the laboratory or in the field. Relative amounts may be chosen by applying the principles discussed herein or by applying Equation 1 or a similar formula relating burn rate and quantities of materials.

Regardless of what slow burn rate material is used, it is preferably mixed with the other component to achieve a substantially consistent, well-mixed mixture. Such a mixture helps to avoid having uneven burn rates in large portions of the propellant bulk. Regardless of how well mixed the mixed propellants are, they will not likely be intimate mixtures, as that term is used herein, because the mixed propellant comprises discrete particles of fuel/oxidizer matrix and oxidizer particles.

Another way of achieving a more consistent, even mixture when combining small particles with binder, oxidizer, low energy propellant, or any other such material having larger sized particles is to press the powder into "macroparticles" as described above. The particles thus formed can be sized by conventional techniques as known in the art, such as the use of screens, to select macroparticles having a particular size or range of sizes. Preferably the size chosen for the macroparticles is substantially the same or of the same order of magnitude as the components with which they are mixed, so as to more easily enable the formation of a relatively uniform mixture of the larger particles.

Several mixed propellants of the present invention, comprising two components (i.e. propellants, fuel/oxidizer mixture), have been prepared, and tested according to the general procedure described above. The propellants made had varying amounts of low and high burning propellant components. The composition is listed in the tables in terms of the quantity of NRC-4 present, expressed as a percentage by weight. The remainder of the propellant comprises HTPB and its stoichiometric quantity of AP. The mixed propellants were made by mixing the various components, together in the presence of nonpolar solvent which is later evaporated, as described in Example 8 above (albeit accounting for differing quantities of propellant components). The HTPB in the propellant formulations was used neat, without a curing agent, such that the propellant could be loaded into the test motor immediately after mixing and burned thereafter, without having to wait for the material to cure, although it was not a necessity that the loading and testing be done immediately following mixing. Additionally, burn rate catalyst was not added to the propellant mixtures tested herein. The results of these experiments are presented in Tables 6 and 7 below.

TABLE 6

NRC-4 Containing Propellants in the 12:1 Mini-Motor

| % NRC-4 | Propellant (g) | Burn rate (in/sec) | Burn Time (sec) | Average Thrust (g) | Propulsion Potential (Isp) (sec) |
|---|---|---|---|---|---|
| 70 | 1.519 | 0.933 | 1.59 | 30.527 | 31.9 |
| 60 | 1.411 | 0.434 | 4.56 | 35.626 | 25.2 |
| 50 | 1.770 | 0.250 | 8.57 | 1.888 | 9.1 |

TABLE 7

NRC-4 Containing Propellants in the 5:1 Mini-Motor

| % NRC-4 | Propellant (g) | Burn rate (in/sec) | Burn Time (sec) | Average Thrust (g) | Propulsion Potential (Isp) (sec) |
|---|---|---|---|---|---|
| 65 | 0.574 | 0.395 | 1.98 | 5.814 | 20.1 |
| 60 | 0.564 | 0.373 | 1.86 | 5.901 | 19.5 |
| 50 | 0.443 | 0.361 | 1.97 | 2.041 | 9.1 |
| 40 | 0.537 | 0.182 | 5.22 | 0.403 | 3.9 |
| 35 | 0.568 | 0.139 | 7.19 | 0.265 | 3.4 |
| 20 | 0.615 | 0.056 | 19.17 | 0.053 | 1.7 |

As can been seen in the tables above, relatively small changes in the composition of the propellant (ratio of high and low burn-rate propellant components) can have a dramatic effect on the Propulsion Potential when the propellant is combusted. Furthermore, tests such as those above can be used to aid in devising a formulation to achieve particular results. Using the data above, for example, if one wanted to make a propellant having a Propulsion Potential of 5, one would need to prepare a propellant having a little over 40% NRC-4 by weight if a 5:1 mini motor were used. The formulation required may be found more exactly by methods known in the art, including fitting the experimental data to an equation or iteratively by preparing and testing additional formulations within the narrowed ranges determined using the data above.

Another way of achieving a propellant with particular burn rate and thrust characteristics is to increase the particle size of the fuel. As discussed above and demonstrated by the data presented in Table 5, reaction rates, such as burn rate, correspond to the reactant diffusion distance. In particulate materials, the diffusion distance corresponds to particle size. This can be understood by a simple model. If each of the two reactants, A and B, were in the form of a powder pressed into spheres the size of marbles, the farthest any two reactant molecules should have to travel is the combined diameters of the A and B marbles, or about an inch. If, however, each of the reactants were powders pressed into spheres the size of bowling balls, the farthest distance any two particles would have to travel would be on the order of a foot, or the combined diameters of the two bowling balls.

Therefore, by choosing the proper size metal fuel particles to include in a composition according to preferred embodiments of the present invention in which the fuel particles are distributed substantially uniformly throughout a stoichiometric amount of oxidizer, a propellant could be made having a preselected burn rate. For example, if a propellant were desired which had a burn rate slower than NRC-4, one could prepare a propellant according to the methods described above for NRC-4 in which the nanoaluminum is replaced with a larger sized particle, of a size up to and including particles several microns in diameter. A micron-fuel based propellant would be advantageous in that micron sized aluminum is commercially available and is cheaper per pound than is nanoaluminum as of this date. Furthermore, adjustment of the burn rate by increasing the particle size allows for the adjustment without adding a low burn rate component, such as HTPB, which provides little power per pound. Thus, basing a propellant on a composition according to the present invention based upon micron-sized fuel particles could provide a propellant well suited for use in applications such as the Space Shuttle, Delta rockets, or other commercial aerospace vehicles, for which nanoaluminum based propellants such as NRC-4, which if used without a low burn rate material, may prove more energetic than is necessary.

The results of additional experiments conducted by the Inventors are presented in Appendix 1 hereto. These tests were conducted using laboratory scale mini-motors of varying aspect ratios, some of which also comprised a flow-restricting nozzle. Appendix 1 details the formulation (%NRC-¾ to %HTPB with its stoichiometric quantity of AP), the mass of the propellant in grams, the density at which the propellant is packed in the motor casing, the pressure in the combustion chamber, whether there was a nozzle present, the orifice size of the nozzle, the length of propellant in the motor casing, the burn time, the burn rate, the aspect ratio, the thrust, and the Isp for several different mixed propellant compositions. The blank spaces indicate where particular data is unavailable or not applicable.

While a typical thrust analysis of a conventional rocket motor involves a high pressure component, one should realize that this higher pressure at which combustion occurs is not achieved without a loss of energy in the exhaust gases. That is, such higher pressures are typically achieved by means of throat or a nozzle which "chokes" the flow of the exhaust gases. True, such a nozzle increases the speed of the gases through the nozzle but it also decreases the energy of other gases which impinge on the narrowed throat structure. This in turn results in an increased pressure which heretofore has been necessary to increase temperatures in the combustion chamber, thereby increasing the burn rate.

However, given a chemical reaction which produces sufficient energy and higher burn rates at lower, say near ambient pressures, there is no reason why reasonable thrust cannot be achieved without a nozzle and the associated higher pressure. In other words, the kinetic energy of the combustion, which produces expanding gases having a given mass moving at a high velocity, is sufficient to produce the momentum transfer necessary to achieve reasonable thrust. This is achieved in the present case by relatively high burn rates at near ambient pressures, which burn rates were not previously achievable without higher pressures. Of course, at higher pressures which could be achieved with some type of throat or nozzle device, even higher burn rates are likely to be achievable. Thus, rocket motors utilizing propellants of the type described herein operating at pressures other than ambient or near ambient are also within the scope of the preferred embodiments.

The above description discloses several methods and materials of the present invention. This invention is susceptible to modifications in the methods and materials, such as the choice of fuel, oxidizer, particle sizes, high or low burn rate propellants, etc. used in the composition and propellant formulations, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims.

APPENDIX I

Additional Mini-Motor Data

| Experiment Run/File | % NRC-3/4/ % HTPB + AP | Prop. Mass grams | Density g/cc | Pressure psig | Nozzle Y/N | Nozzle Orifice (in.) | Motor Length Prop., in. | Burn Time sec | Burn Rate in./sec. | Aspect Ratio | Thrust grams | Isp sec. |
|---|---|---|---|---|---|---|---|---|---|---|---|---|
| scope89.mac/2 | 60/40 | 0.84 | 1.903241 | 75.1 | Y | 0.081 | 0.96 | 0.683 | 1.41 | 5.079365 | 83.4 | 67.8 |
| scope87.mac/5 | 85/15 | 0.8 | 1.72801 | 294.5 | Y(.052) | 0.081 | 1.007 | 0.124 | 8.12 | 5.328042 | 528 | 81.8 |
| scope83.mac/10 | 85/15 | 0.38 | 1.707749 | 235.3 | Y | 0.081 | 0.484 | 0.078 | 6.19 | 2.560847 | 477.5 | 98.0 |
| scope79.mac/13 | 85/15 | 0.36 | 1.544473 | 173.6 | Y | 0.089 | 0.507 | 0.0947 | 5.35 | 2.68254 | 395.7 | 104.1 |
| scope77.mac/15 | 85/15 | 0.36 | 1.594802 | 73.5 | Y | 0.101 | 0.491 | 0.139 | 3.53 | 2.597884 | 214 | 82.6 |
| scope75.mac/17 | 85/15 | 0.37 | 1.599998 | 15.6 | Y | 0.128 | 0.503 | 0.18 | 2.76 | 2.661376 | 137.5 | 66.9 |
| scope73.mac/19 | 85/15 | 0.35 | 1.572926 | | Y | 0.154 | 0.484 | 0.294 | 1.65 | 2.560847 | 43 | 36.1 |
| scope71.mac/21 | 85/15 | 0.35 | 1.586034 | | Y | 0.169 | 0.48 | 0.273 | 1.76 | 2.539683 | 44.3 | 34.6 |
| scope59a-h.dat/31 | 85/15 | 0.523 | 1.702986 | | N | | 0.668 | 0.85 | 0.79 | 3.534392 | 16 | 26.0 |
| scope58a-h.dat/32 | 85/15 | 0.591 | 1.876647 | | N | | 0.885 | 1.35 | 0.5 | 3.624339 | 6 | 13.7 |
| scope59a-h.dat/35 | 85/15 | 0.523 | 1.702986 | | N | | 0.668 | 0.85 | 0.79 | 3.534392 | 16 | 26.0 |
| scope58a-f.dat/37 | 85/15 | 0.591 | 1.876647 | | N | | 0.685 | 1.35 | 0.5 | 3.624339 | 6 | 13.7 |
| scope49a-f.dat/41 | 85/15 | 0.273 | 0.590857 | | N | | 1.005 | 0.227 | 4.43 | 5.31746 | 48 | 39.9 |
| scope48a-f.dat/42 | 85/15 | 0.439 | 0.950133 | | N | | 1.005 | 0.261 | 3.85 | 5.31746 | 85 | 50.5 |
| scope47a-f.dat/43 | 85/15 | 0.53 | 1.147085 | | N | | 1.005 | 0.271 | 3.71 | 5.31746 | 108 | 55.2 |
| scope45.mac/48 | 85/15 | 0.689 | 1.495675 | | N | | 1.002 | 0.229 | 4.37 | 5.301587 | 110.3 | 36.7 |
| scope40.mac/49 | 85/15 | 0.548 | 1.188407 | | N | | 1.003 | 0.228 | 4.4 | 5.306878 | 157.1 | 65.4 |
| scope36.mac/50 | 85/15 | 0.676 | 1.480755 | | N | | 0.993 | 0.3 | 3.31 | 5.253968 | 124.6 | 55.3 |
| scope32.dat/51 | 70/30 | 2.22 | 1.678277 | | N | | 3.003 | 4.09 | 0.734 | 16.23243 | 34.76 | 64.0 |
| npct31.dat/54 | 50/50 | 2.45 | 1.841726 | | N | | 3.02 | 9.78 | 0.31 | 16.32432 | 1.67 | 6.7 |
| idmcap4.dat/56 | 60/40 | 1.801 | 1.817176 | | N | | 2.25 | 14.9 | 0.151 | 12.16216 | 0.81 | 6.7 |
| npct36.dat.scope36.da | 85/15 | 0.676 | 1.480755 | | N | | 0.993 | 0.313 | 3.173 | 5.253968 | 219 | 101.4 |
| scope37.dat/59 | 83/17 | 0.665 | 1.442137 | | N | | 1.003 | 0.301 | 3.332 | 5.306878 | 222 | 100.5 |
| npct33.dat/60 | 85/15 | 1.625 | 1.557088 | | N | | 2.27 | 1.44 | 1.57 | 12.01058 | 101.8 | 90.2 |
| scope29.mac/61 | 77.5/22.5 | 1.597 | 1.543861 | | N | | 2.25 | 1.886 | 1.19 | 11.90476 | 33.2 | 39.2 |
| plastic1.dat/62 | 80/20 | 0.326 | 1.434592 | | N | | 1.13 | 1.26 | 0.897 | 9.04 | 21.81 | 84.3 |
| npct28.mac/75 | 85/15 | 1.528 | 1.455805 | | N | | 2.283 | 1.203 | 1.9 | 12.07937 | 73.3 | 57.7 |
| npct27.mac/76 | 80/20 | 1.555 | 1.478938 | | N | | 2.287 | 1.37 | 1.67 | 12.10053 | 48.8 | 43.0 |
| scope26.mac/77 | 70/30 | 1.627 | 1.550807 | | N | | 2.282 | 2.141 | 1.07 | 12.07407 | 28.2 | 37.1 |
| scope25.mac/78 | 70/30 | 1.659 | 1.577161 | | N | | 2.288 | 2.473 | 0.925 | 12.10582 | 17.6 | 26.2 |
| scope19.mac/79 | 70/30 | 1.519 | 1.428459 | | N | | 2.313 | 1.977 | 1.17 | 12.2381 | 34.3 | 44.6 |
| npct18.mac/80 | 60/40 | 1.411 | 1.311586 | | N | | 2.34 | 5.101 | 0.46 | 12.38095 | 7.2 | 26.0 |
| npct21.mac/81 | 50/50 | 1.77 | 1.659476 | | N | | 2.32 | 9.219 | 0.252 | 12.27513 | 1.8 | 9.4 |
| npct24.dat/82 | 70/30 | 0.743 | 1.594373 | | N | | 1.003 | 2.4 | 0.42 | 5.278947 | 10.65 | 34.4 |
| npct23.dat/83 | 70/30 | 0.754 | 1.617978 | | N | | 1.003 | 2.22 | 0.45 | 5.278947 | 10.85 | 31.9 |
| npct20.dat/87 | 75/25 | 1.645 | 1.52609 | | N | | 2.32 | 2.544 | 0.912 | 12.21053 | 36.67 | 56.7 |

What is claimed is:

1. A propellant, comprising a first propellant comprising a first fuel and first oxidizer composition having a controlled stoichiometry, said composition comprising a matrix comprising a known quantity of said first oxidizer existing substantially in non-crystalline form determined in accordance with said controlled stoichiometry; and a known quantity of said first fuel determined in accordance with said controlled stoichiometry, wherein particles of said first fuel are substantially uniformly distributed throughout said first oxidizer matrix and confined solely to said matrix; and a second propellant composition comprising a second fuel and a second oxidizer.

2. The propellant of claim 1, wherein the second propellant is present in a quantity sufficient to modify the burn rate of the first propellant to achieve a preselected burn rate.

3. The propellant of claim 1, wherein the first fuel is independently selected from the group consisting of aluminum, boron, beryllium, lithium, zirconium, sodium, potassium, magnesium, calcium, bismuth, mixtures thereof, and alloys thereof.

4. The propellant of claim 1, wherein the first and second oxidizer are independently selected from the group consisting of ammonium perchlorate, aluminum perchlorate, potassium perchlorate, potassium chlorate, potassium nitrate, lithium nitrate, molybdenum trioxide, cyclotetramethylenetetranitramine, cyclotrimethylenetrinitramine, lower alkyl ammonium nitrate, lower alkyl hydroxylammonium nitrate, hydroxylammonium nitrate, hydrazinium nitrate, fluorocarbon polymer, fluorochlorocarbon polymer, ammonium nitrate and mixtures thereof.

5. The propellant of claim 1, wherein the binder is selected from the group consisting of HTPB, CTPB, and Viton.

6. The propellant of claim 1, wherein the first oxidizer and first fuel are present in stoichiometric quantities.

7. The propellant of claim 1, wherein the second propellant comprises a substantially homogeneous mixture of the second fuel and the second oxidizer, wherein the second fuel is in the form of discrete particles distributed substantially uniformly throughout a matrix of the second oxidizer, and wherein the relative quantities of the second fuel and the second oxidizer are controlled.

8. The propellant of claim 1, wherein the particles of the first fuel have a diameter of about 10 nanometers to about 10 micrometers.

9. The propellant of claim 1, wherein the particles of the first fuel have a diameter of about 0.1 micrometer to 1 micrometer.

10. The propellant of claim 1, wherein the particles of the first fuel have a diameter of about 20 nanometers to about 40 nanometers.

11. A solid propellant, comprising:

macroparticles of the first propellant claim 1; and a binder and stoichiometric quantity of a second oxidizer.

12. The solid propellant of claim 11, wherein the first and second oxidizers are the same material.

13. A solid propellant comprising a metallic fuel and oxidizer, said propellant having a burn rate at near ambient pressure sufficiently high as to achieve adequate thrust to lift a payload.

14. The propellant of claim 1, wherein the second fuel is a binder which binds particles of said first propellant.

15. The propellant of claim 1, wherein the first and second oxidizers are the same compound.

16. The propellant of claim 1, wherein the first and second oxidizers are different compounds.

17. The propellant of claim 1, wherein the second propellant comprises a second fuel and oxidizer composition having a controlled stoichiometry.

18. The propellant of claim 1, wherein the second fuel is a binder and comprises a matrix in which the second oxidizer and the first propellant are uniformly distributed.

19. The propellant of claim 1, wherein the second fuel is a binder.

20. A propellant, comprising:

a first propellant comprising a first fuel and a fuel oxidizer, said first fuel oxidizer comprising a first matrix;

a second propellant comprising a second fuel and a second fuel oxidizer;

wherein said first fuel is uniformly distributed throughout said first matrix, and particles of the first propellant are uniformly distributed throughout the second propellant said first matrix being prepared from a non-saturated solution of said first fuel oxidizer, said first fuel, and a solvent which solution is well agitated to substantially uniformly distribute particles of said first fuel throughout said solution, the solvent being removed from said solution such that said uniform distribution of said first fuel particles throughout said first oxidizer is maintained.

21. The propellant of claim 20, wherein the second fuel is a binder and the first fuel is selected from the group consisting of aluminum, boron, beryllium, lithium, zirconium, sodium, potassium, magnesium, calcium, bismuth, mixtures thereof, and alloys thereof.

22. The propellant of claim 20, wherein the first propellant has a controlled stoichiometry.

23. The propellant of claim 1, wherein the first and second fuels are the same compound.

24. The propellant of claim 1, wherein the first and second fuels are different compounds.

25. A propellant, comprising a first propellant comprising a first fuel and first oxidizer composition having a controlled stoichiometry, said composition comprising a matrix comprising a known quantity of said first oxidizer existing substantially in non-crystalline form determined in accordance with said controlled stoichiometry, and a known quantity of said first fuel determined in accordance with said controlled stoichiometry, wherein particles of said first fuel are substantially uniformly distributed throughout said first oxidizer matrix, said matrix being prepared from a non-saturated solution of said first oxidizer, said first fuel, and a solvent which solution is well agitated to substantially uniformly distribute particles of said first fuel throughout said solution, the solvent being removed from said solution such that said uniform distribution of said first fuel particles throughout said first oxidizer matrix is maintained and such that said known quantities of said first oxidizer and said first fuel are maintained in the matrix whereby the stoichiometry of said composition is controlled; and a second propellant composition comprising a second fuel and a second oxidizer.

26. A propellant, comprising a first propellant comprising a first fuel and first oxidizer composition having a controlled stoichiometry, said composition comprising a matrix comprising a known quantity of said first oxidizer determined in accordance with said controlled stoichiometry, and a known quantity of said first fuel determined in accordance with said controlled stoichiometry, wherein particles of said first fuel are substantially uniformly distributed throughout said first oxidizer matrix, said matrix being prepared from a non-saturated solution of said first oxidizer, said first fuel, and a solvent which solution is well agitated to substantially uniformly distribute particles of said first fuel throughout said solution, the solvent being removed from said solution such that said uniform distribution of said first fuel particles throughout said first oxidizer matrix is maintained and such that said known quantities of said first oxidizer and said first fuel are maintained in the matrix whereby the stoichiometry of said composition is controlled; and a second propellant composition comprising a second fuel and a second oxidizer.

* * * * *